US007517108B2

(12) United States Patent
Galli et al.

(10) Patent No.: US 7,517,108 B2
(45) **Date of Patent: *Apr. 14, 2009**

(54) FLASHLIGHT HAVING MATING FORMATIONS FOR INTEGTRATION WITH A RAIL MOUNTING SYSTEM

(75) Inventors: Robert D. Galli, 135 Circuit Dr., North Kingstown, RI (US) 02852; Marco Wo, Providence, RI (US)

(73) Assignee: Robert D. Galli, North Kingstown, RI (US)

( * ) Notice: Subject to any disclaimer, the term of this patent is extended or adjusted under 35 U.S.C. 154(b) by 314 days.

This patent is subject to a terminal disclaimer.

(21) Appl. No.: 11/756,693

(22) Filed: Jun. 1, 2007

(65) Prior Publication Data

US 2007/0230162 A1 Oct. 4, 2007

Related U.S. Application Data

(63) Continuation of application No. 11/426,609, filed on Jun. 27, 2006, now Pat. No. 7,226,183.

(60) Provisional application No. 60/694,732, filed on Jun. 28, 2005.

(51) Int. Cl.
*F21V 33/00* (2006.01)

(52) U.S. Cl. ..... 362/191; 362/110; 362/253; 362/396

(58) Field of Classification Search ..... 362/190, 362/191, 110, 111, 113, 114, 103, 105, 106, 362/253, 396

See application file for complete search history.

(56) References Cited

U.S. PATENT DOCUMENTS

| | | | |
|---|---|---|---|
| 4,845,871 | A | 7/1989 | Swan |
| 4,939,863 | A | 7/1990 | Alexander et al. |
| 5,142,806 | A | 9/1992 | Swan |
| 5,276,988 | A | 1/1994 | Swan |
| 5,343,650 | A | 9/1994 | Swan |
| 5,430,967 | A | 7/1995 | Woodman, III et al. |
| 5,533,292 | A | 7/1996 | Swan |
| 6,206,543 | B1 | 3/2001 | Henry |
| 6,490,822 | B1 | 12/2002 | Swan |
| 6,616,294 | B1 | 9/2003 | Henry |
| 6,618,976 | B1 | 9/2003 | Swan |
| D507,620 | S | 7/2005 | Swan |
| 7,226,183 | B2 | 6/2007 | Galli et al. |

*Primary Examiner*—Laura Tso
(74) *Attorney, Agent, or Firm*—Barlow, Josephs & Holmes, Ltd.

(57) ABSTRACT

A modular flashlight assembly is provided that includes an integrated interface to facilitate mounting of the flashlight to a variety of different equipment. The flashlight mounting system includes a pattern of engagement surfaces on an exterior surface of the flashlight housing and a mounting bracket. The mounting bracket is configured to be mounted onto the desired substrate and includes clamping members that releasably engage the engagement surfaces on the flashlight housing. In this manner, the engagement surfaces on the flashlight housing provide a surface by which the flashlight can be clamped without the need for a band that extends entirely around the barrel of the flashlight. Further, by releasably clamping the flashlight into a modular system, the flashlight can easily mounted onto any variety of different modular interface systems such as the interface rail that is integrated onto modern type firearms.

14 Claims, 7 Drawing Sheets

FLASHLIGHT HAVING MATING FORMATIONS FOR INTEGTRATION WITH A RAIL MOUNTING SYSTEM

CROSS-REFERENCE TO RELATED APPLICATIONS

This application is related to and is a continuation of U.S. patent application Ser. No. 11/426,609, filed Jun. 27, 2006, now U.S. Pat. No. 7,226,183, which claims priority from earlier filed US Provisional Patent Application No. 60/694,732, filed Jun. 28, 2005, the contents of which are all incorporated herein by reference.

BACKGROUND OF THE INVENTION

The present invention relates generally to a flashlight that is configured in a manner that includes an integrated mounting interface. More specifically, the present invention relates to a compact, high intensity flashlight assembly that is highly durable and includes an integrated mounting interface, thereby making the flashlight capable of being utilized as an accessory for a variety of devices such as standard military style rail type mount for example.

In the prior art, flashlights for use in military applications have typically been constructed in a standard fashion utilizing a tubular outer housing. As a consequence, in order to facilitate mounting of the flashlight onto other devices, such as military weapons, a relatively large mounting assembly was required. Usually, the prior art mounting assembly that is used in connection with a flashlight having conventional construction includes a heavy gauge band that is wrapped around the entire outer housing of the flashlight. In addition, these bands include projections from at least one side where a large thumbscrew is positioned to allow a user to tighten the band around the flashlight. The difficulty encountered with this construction is that in some cases it creates a greater opportunity for the flashlight and mounting assembly to be caught on clothing or brush while the firearm is being carried, thereby knocking the flashlight out of alignment, dislodging the flashlight from the firearm or damaging the flashlight. Further, the interface between the outer tubular housing and the mounting band leaves the potential that the flashlight may slide or rotate within the band requiring frequent repositioning. While this may be acceptable for a sport type firearm, it is not acceptable for a firearm employed for field use, such as hunting or combat environments where immediate, fully aligned use of the flashlight assembly is required.

A further drawback associated with the prior art style flashlight mounts is that they do not provide a modular integrated mounting platform that allows the flashlight to be incorporated into a military weapons system. In other words, the prior art systems do not allow quick removal and reattachment of a flashlight with respect to a military firearm system. Additionally, the prior art systems do not include a modular arrangement that in turn allows integration of the flashlight into other environments such as integration for use as a helmet mounted light.

In view of the foregoing disadvantages inherent in the prior art devices, there is a need for a assembly that provides an improved method of compactly and reliably mounting a flashlight onto a firearm. There is a further need for an interfaceable flashlight assembly that provides an improved engagement method for firearms that has the ability to consistently and quickly engage, and provide accurate alignment, while providing a reduced profile, thereby reducing potential interference with other devices and attachments. There is still a further need for an interfaceable flashlight system that is modular in nature allowing for the flashlight to be easily utilized with a variety if different equipment.

BRIEF SUMMARY OF THE INVENTION

In this regard, the present invention provides for a novel modular flashlight assembly that includes an interface integrated into the housing thereof to facilitate mounting of the flashlight to a variety of different equipment. Generally, the flashlight includes at least a pair of engagement surfaces formed on the housing thereof, which are engaged by an interface clamp that in turn facilitates mounting of the flashlight to the desired device. In the preferred embodiment, the engagement surfaces are formed as a pattern of alternating raised ribs and recesses that are radially arranged around the exterior of its housing in a manner that allows the flashlight to have an aesthetic appearance even when being used as a stand alone device. The interface clamp is configured to be mounted onto the desired substrate and includes clamping members that releasably engage the engagement surfaces on housing of the flashlight. In this manner, the ribs on the flashlight housing provide the engagement surface by which the flashlight can be clamped without the need for a band that extends entirely around the barrel of the flashlight as was the case in the prior art.

The novel clamping arrangement and the manner in which it engages the housing of the flashlight allows for the flashlight to be easily mounted onto any variety of different modular interface systems such as the interface rail that is integrated onto modern type firearms. In the alternative, clamping assemblies may be provided in other locations, such as mounted to the side of a military style helmet thereby allowing the flashlight to be transferred between mounting positions both on the firearm and on the user's helmet.

Accordingly, it is an object of the present invention to provide a flashlight having a housing that includes a mounting interface that is integrated into the construction of its housing. It is a further object of the present invention to provide a flashlight having at least two recesses formed in the housing thereof to facilitate engagement of the flashlight using a clamping assembly. It is still a further object of the present invention to provide a mounting interface that is received as a modular accessory in a military weapon system and serves to releasably engage and retain a flashlight in the desired location adjacent the barrel of a firearm. It is yet a further object of the present invention to provide a modular mounting system using a base member that is configured to engage a substrate and includes releasable clamping means for receiving and retaining a flashlight.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
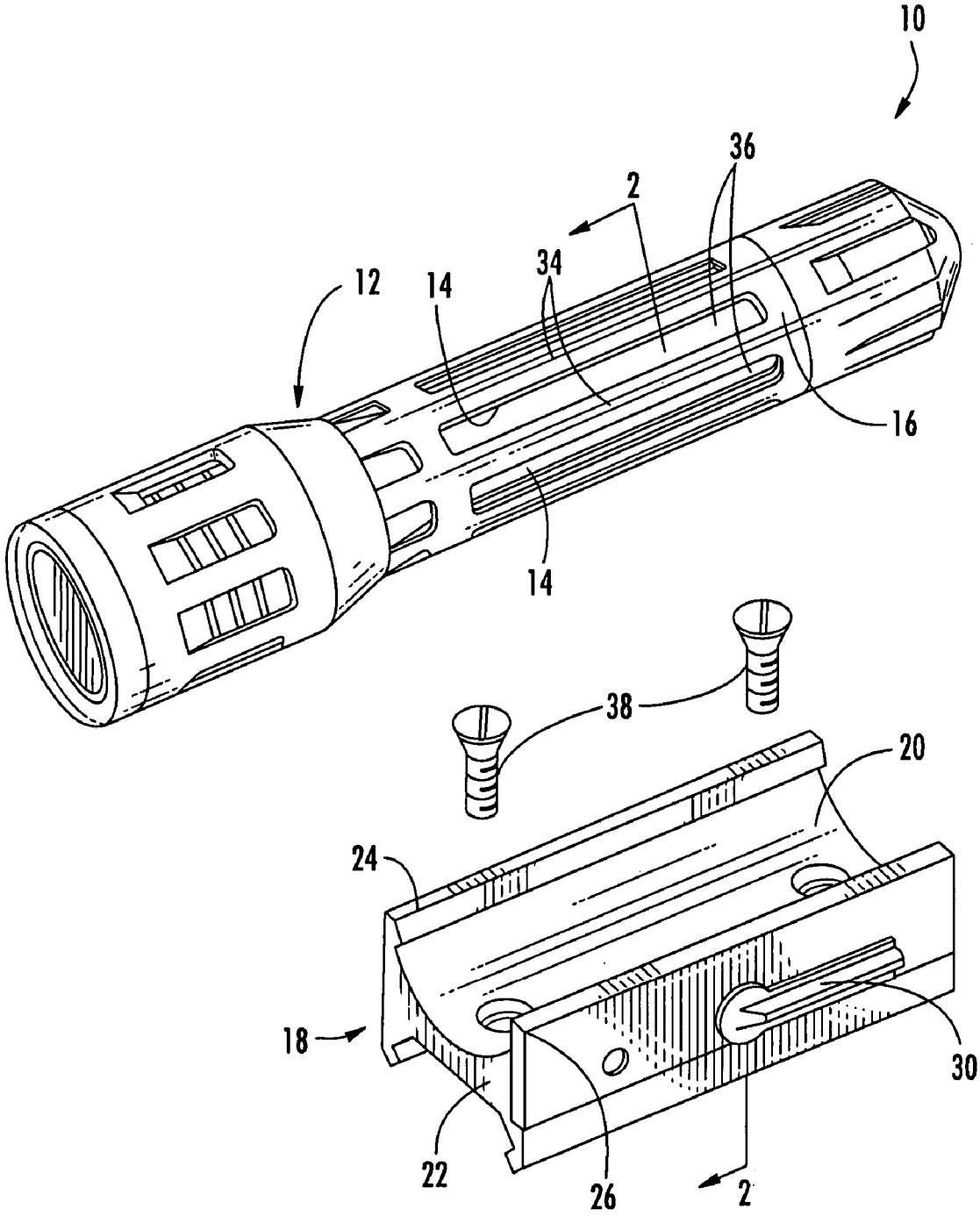
FIG. 1 is a front perspective view of the flashlight interface system of the present invention.

Now referring to the drawings, the flashlight mounting assembly is shown and generally illustrated at 10 in the figures. In particular, the principal components of the flashlight mounting assembly 10 can be seen in FIG. 1. The flashlight mounting assembly 10 generally includes a flashlight 12 with engagement surfaces 14 disposed on its housing 16 and a mounting interface 18 having a first side 20 that is configured to releasably engage the flashlight 12 via the engagement surfaces 14 and a second side 22 that is configured to engage a receiving surface as will be discussed in greater detail below.

The flashlight 12 component of the present invention could be any type of flashlight known in the art having a housing 16 that is constructed in accordance with the teachings of the present invention. More particularly, the flashlight 12 generally includes a housing 16, a light source, a power source and a means for selectively completing a circuit between the light source and power source in order to energize the light source. The light source may be any suitable type of light source commonly found in flashlights including but not limited to incandescent, xenon, halogen, standard light emitting diodes, high output light emitting diodes and any multiple or combination thereof. The light output of the light source may fall anywhere within the visible color range and may also include infrared or ultraviolet. Preferably, the output will be in the visible white range either by using an Indium Gallium Nitride/Gallium Nitride chip with a phosphor coating such as a Nichea white LED. Similarly, as would be obvious in the art other white LED's could easily be substituted for the same effect. For example, an Aluminum Indium Gallium Arsenide LED could easily be substituted.

The flashlight 12 may also include auxiliary lighting functions in combination with or in place of the white light element. The present invention may also include a red light diode for night vision operations, an infrared diode for use in conjunction with night vision goggles or a laser diode for automated firing or targeting systems. Any of these features may be included either alone or in combination in the flashlight 12 of the present invention. Further, the power source may be any suitable power source for use in conjunction with portable lighting devices such as alkaline batteries, lithium batteries, rechargeable batteries of any known chemistry and/or chemical fuel cells. In certain applications, the flashlight 12 may also derive its power from a remote power source such as may be provided on a military weapons system.

The flashlight housing 16 and the mounting interface 18 may be milled or cast from metallic materials. Similarly, the housing 16 and mounting interface 18 may be molded from high strength polymer materials. Finally, the housing 16 and mounting interface 18 may be insert molded using a combination of metallic and polymer components as may be necessary to create the durability and strength demanded by the application.

Figure 2:
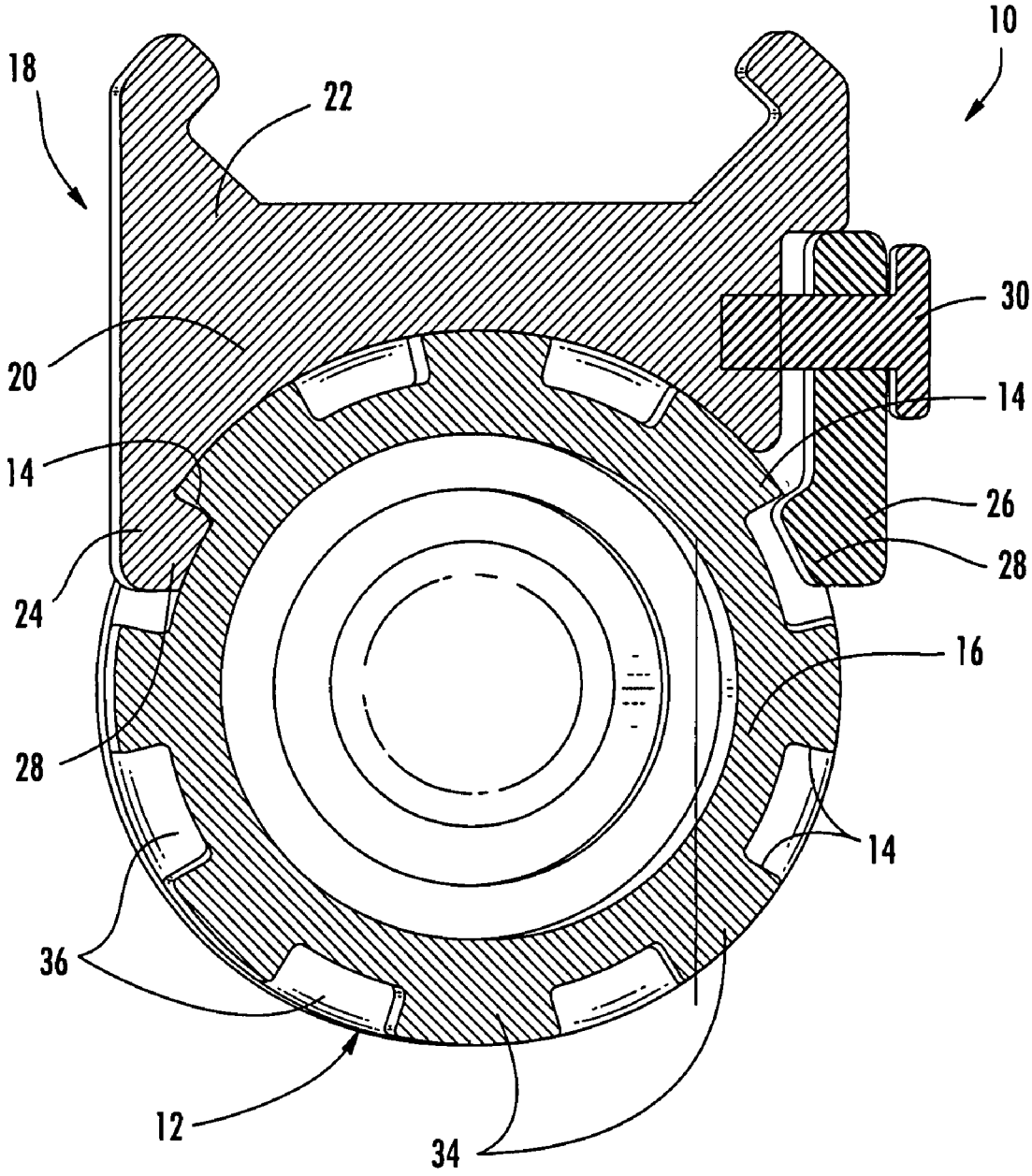
FIG. 2 is a cross sectional view of the assembly taken along line 2-2 of FIG. 1 with the flashlight received in the mounting interface and the interface in a disengaged position.
Figure 3:
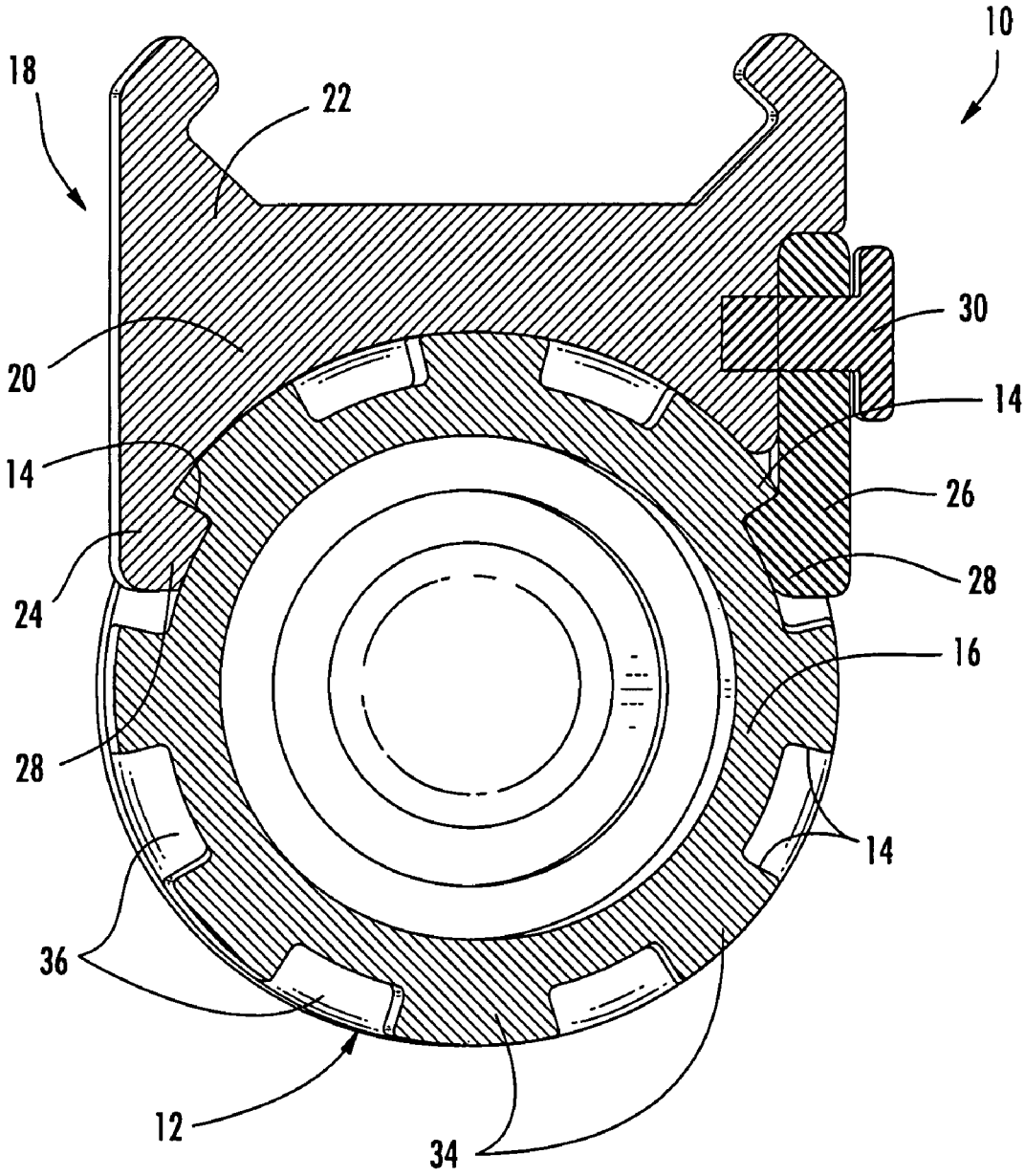
FIG. 3 is a cross sectional view of the assembly taken along line 2-2 of FIG. 1 with the flashlight received in the mounting interface and the interface in an engaged position.

As was stated above, in the context of the present invention, it is important that the housing 16 of the flashlight 12 include at least two engagement surfaces 14 to facilitate engagement between the flashlight 12 and the mounting interface 18. Turning now to FIGS. 2 and 3, the relationship between the flashlight 12 and the mounting interface 18 is depicted, with the flashlight 12 being shown in a mounted position relative to the mounting interface 18. The first side 20 of the mounting interface 18 into which the flashlight housing 16 is received and retained can be seen to include a first clamping arm 24 and a second clamping arm 26 extending therefrom. Further detents 28 extend inwardly at the ends of the first and second clamping arms 24, 26 to engage the interface surfaces 14. The first and second clamping arms 24, 26 cooperate to retain the flashlight 12 by engaging the engagement surfaces 14 on the housing 16 of the flashlight 12 with the detents 28 on the ends of the first and second clamping arms 24, 26 when the first and second clamping arms 24, 26 are in the engaged position as depicted in FIG. 3.

It can be seen by viewing both FIGS. 2 and 3 in conjunction that the first and second clamping arms 24, 26 can be deflected relative to one another to allow insertion and/or removal of the flashlight housing 16 therebetween. The clamping arms 24, 26 may be deflected relative to one another in any manner known to one skilled in the art. For example, the mounting interface 18 may be formed to include limited flexibility in either the base portion or in the clamping arms 24, 26 so that the clamping arms 24, 26 can be deflected simply by flexing the mounting interface 18. Alternatively, the first clamping arm 24 may be rigid relative to the base portion of the mounting interface 18 while the second clamping arm 26 is linearly displaceable between an engaged position as shown in FIG. 3 and a disengaged position as is shown in FIG. 2. The displaceable second clamping arm 26 may be spring biased towards the engaged position and can also be seen to include a locking mechanism 30 in the form of a threaded fastener or throw lever that prevents displacement of the second clamping arm 26 once the flashlight 12 is installed and the first and second clamping arms 24, 26 are in the engaged position.

Figure 4:
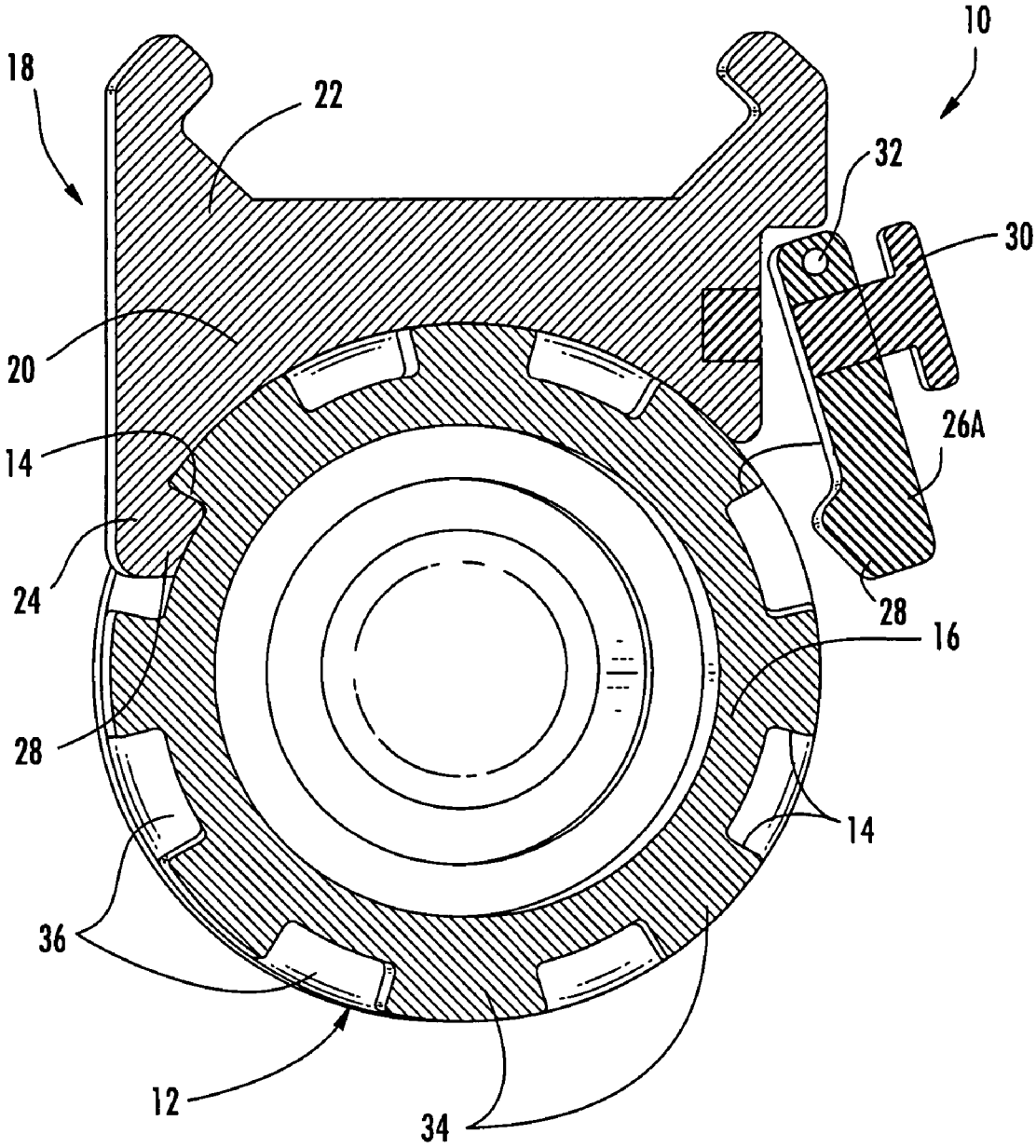
FIG. 4 is a cross sectional view of an alternate embodiment mounting interface with the interface rotated to a disengaged position.
Figure 5:
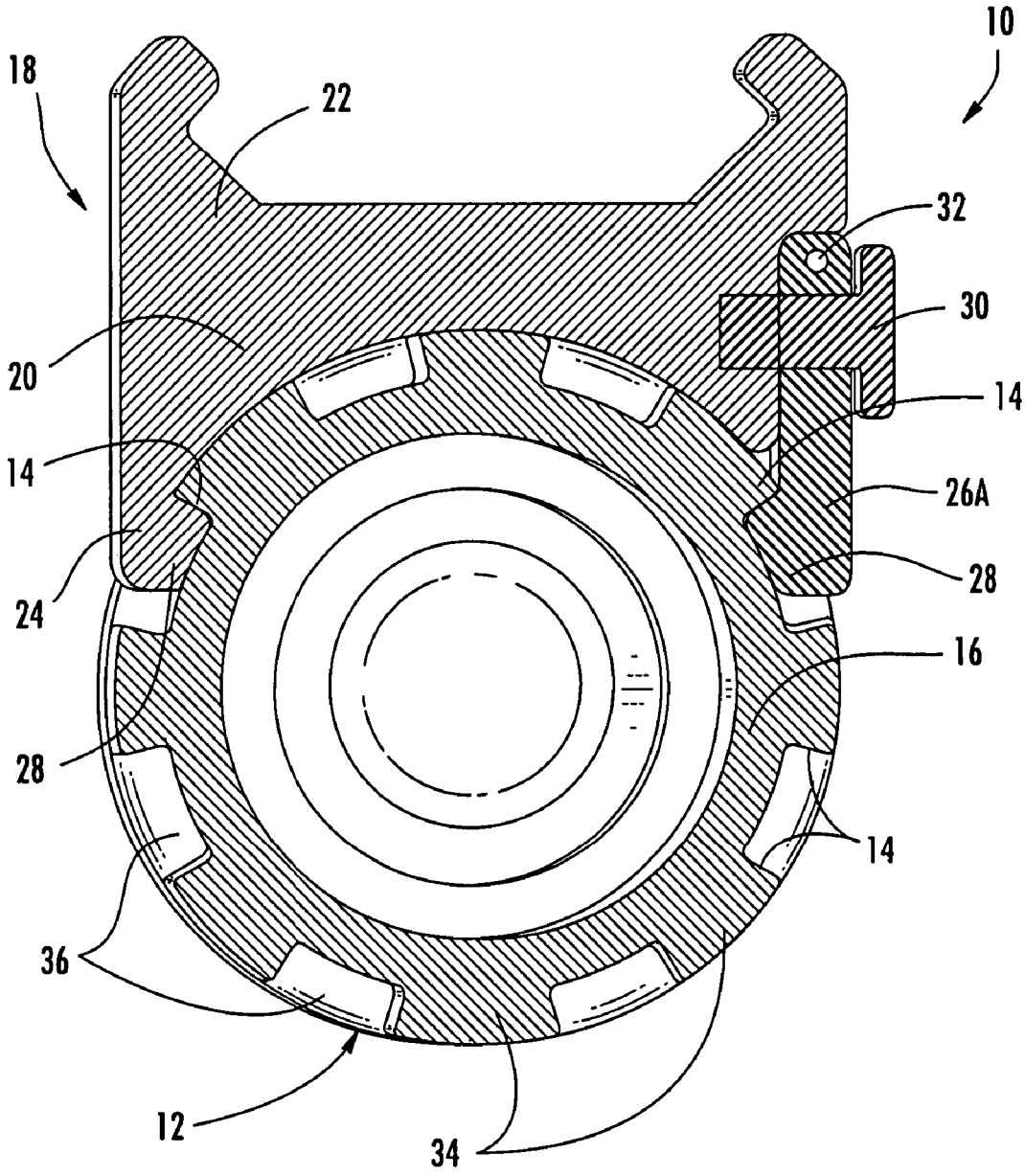
FIG. 5 is a cross sectional view of the mounting interface of FIG. 4 with the interface rotated to an engaged position.

Turning to FIGS. 4 and 5 the second clamping arm 26A is shown as being displaceable through rotation relative to the base portion of the mounting interface 18. In this embodiment, the second clamping arm 26A is attached to the mounting interface 18 using a pin 32 around which the second clamping arm 26A can rotate. As was stated above, a locking mechanism 30 is provided in the form of a threaded fastener or throw lever that prevents displacement of the second clamping arm 26A once the flashlight 12 is installed and the first and second clamping arms 24, 26A are in the engaged position.

Regardless of the form that the second side 22 mounting interface 18 takes or the receiving surface to which the mounting interface 18 will be attached, the interaction between the mounting interface 18 and the flashlight 12 remains the same. The flashlight housing 16, as was stated earlier, includes at least two interface surfaces 14 formed thereon. The interface surfaces 14 are configured and arranged in a manner so as to be inclined at a slight oblique angle relative to one another. The reason for angling the engagement surfaces 14 relative to one another is that once the flashlight 12 is engaged in the mounting interface 18, the angled interface surfaces 14 firmly lock the flashlight 12 between the clamping arms 24, 26 and prevent the flashlight 12 from being knocked therefrom. In the preferred embodiment, the flashlight housing 16 includes at least two ribs 34 extending from the exterior surface of the housing 16 wherein the ribs 34 are disposed at an oblique angle relative to one another. It is still more preferred that the ribs 34 are arranged radially relative to the flashlight housing 16 such that the engagement surfaces 14 are parallel to a line extending through the center of the flashlight housing 16. It is most preferred that the engaging surfaces 14 be formed as an array of alternating ribs 34 and recess 36 uniformly arranged in a radial array around the exterior surface of the flashlight housing 16. In this configuration, the engagement surfaces 14 are provided in a manner that allows the flashlight 12 to be installed into the mounting interface 18 reliably and in virtually any orientation. In addition, the formation of the ribs 34 and recesses 36 provide for a flashlight housing 16 that is effective for mounting yet still appears as aesthetically pleasing for stand alone use while also including a rugged grip pattern that makes the flashlight 12 easy to hold when not received in the mounting interface 18.

Figure 6:
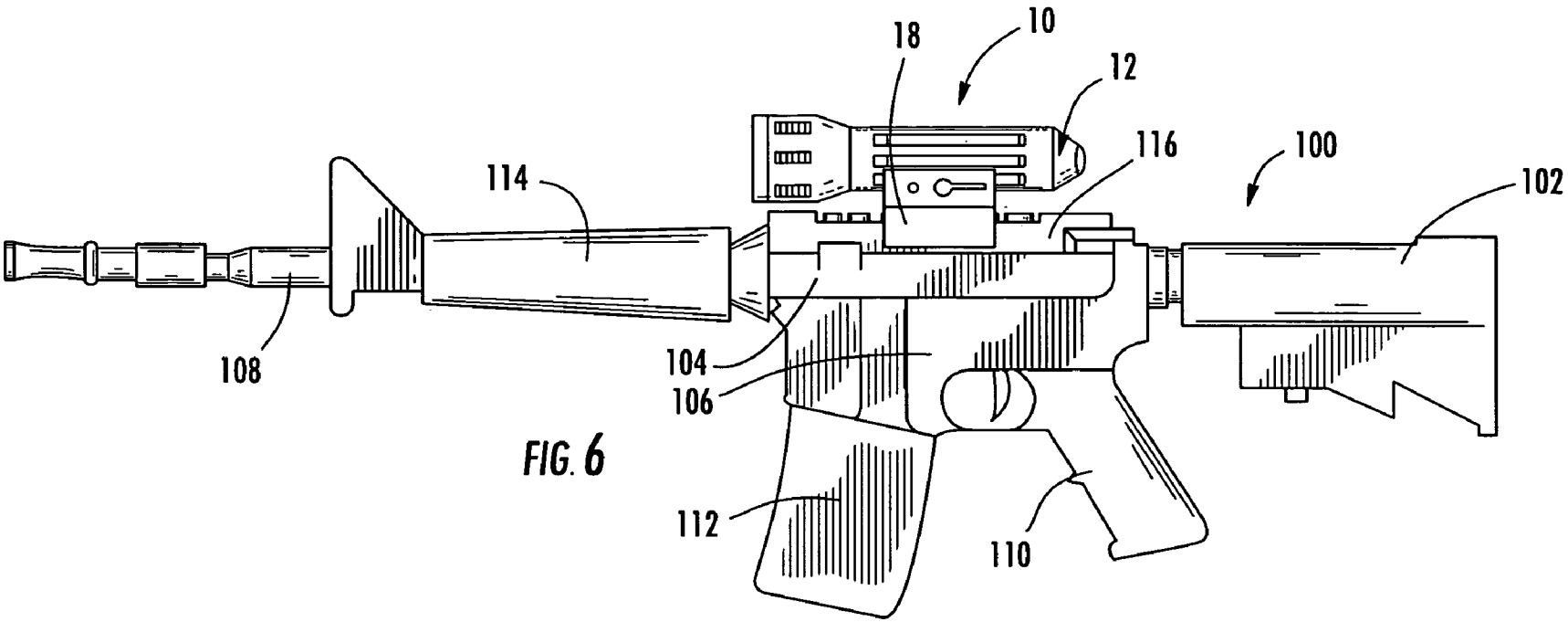
FIG. 6 depicts the flashlight interface system mounted onto a standard issue military rifle.

The second side 22 of the mounting interface 18 in its simplest form may be flat and attached to a receiving surface using threaded fasteners 38 as are depicted in FIG. 1. The second side 22 of the mounting interface 18 may also be formed as is depicted in the figures to include an interface suitable for engagement with a dovetail rail. In FIG. 6 there is shown an outline of a conventional combat firearm 100 having a conventional stock 102, upper receiver 104 with flattop, lower receiver 106, barrel 108, pistol grip 110, and magazine 112. The barrel 108 is joined to the upper receiver 104. The barrel 108 defines the forward portion of the firearm 100 and the stock 102 defines the rearward portion of the firearm 100. The longitudinal axis of the firearm 100 runs from stock 102 through receiver 104, 106 to barrel 108. The barrel 108 is joined to the forward portion of the upper receiver 104, i.e., the upper receiver "receives" the barrel. The stock 102 is joined to the rear portion of the upper receiver 104. The barrel 108 has protective hand guards 114 about its circumference.

Generally, such modern type firearms include an interface rail 116 integrated therein for the mounting of auxiliary devices. The rail 116 is known in the art as a Weaver type interface and takes the form of a rail 116 having a dovetail cross-sectional profile that extends over the upper receiver 104 of the firearm 100. Additionally, there are several supplemental rail systems that mount onto such firearms 100 by interfacing with the Weaver rail 116 on the firearm 100 and extending along the barrel 108 to provide additional interface rails 116 both along the top of the firearm 100 as well as at the 3, 6 and 9 o'clock positions around the barrel 108. All of the interface rails 116 are provided having a standardized profile and are configured specifically for the mounting of various accessories depending on the type environment in which the firearm 100 will be used. Accordingly, the formation of the dovetail profile on the second side 22 of the mounting interface 18 allows the mounting interface 18 to be received and retained on the interface rail 116 provided on the firearm 100.

When the flashlight assembly 10 is mounted onto a firearm 100 the lower portion 22 dovetail may be formed as a rigid profile that is simply slid onto the firearm 100 accessory rail 116 and retained in place using setscrews. In the alternative, the dovetail interface may be formed as a clamping assembly to engage the accessory rail 116 on the firearm 100. In this configuration, the mounting interface 18 may include a single tightening mechanism that engages both the second clamping arm 26 that engages the flashlight 12 and the rail interface clamp at the same time. Similarly, the mounting interface 18 may have a separate dedicated clamping member for the dovetail interface. The tightening mechanism for both the clamping arm 26 and the dovetail interface may be set screws, thumb screws, quick release type mechanisms or combinations thereof to allow easy mounting and demounting of the flashlight 12 relative to the firearm 100.

Figure 7:
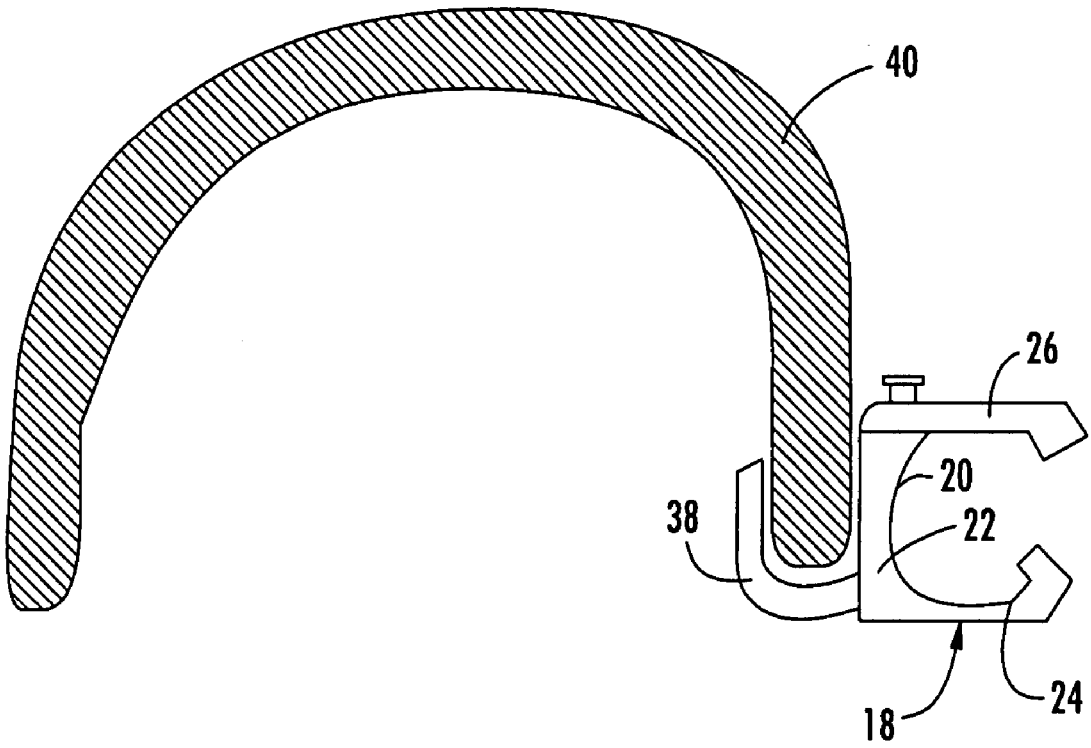
FIG. 7 depicts the flashlight interface system clamp mounted to the side of a helmet.

FIG. 7 depicts the mounting interface 18 with an alternative clamping 38 assembly on the second side 22 thereof. The alternative clamping assembly 38 allows the mounting interface 18 to be fastened onto a helmet 40 such as a standard issue military helmet. The first side 20 of the mounting interface 18 is formed as described above and is configured to receive and engage a flashlight 12 in the same manner as described earlier. In this manner, the same flashlight 12 can be easily used in conjunction with a military rifle 100 or helmet 40 and may also be moved between these locations easily.

It can therefore be seen that the present invention provides a novel flashlight assembly 10 that includes integrated mounting surfaces that allow the flashlight 12 to be received into a durable low profile mounting interface 18. Further, the present invention can be modified to accommodate a number of standard mounting environments through simple changes to the second side 22 of the mounting interface 18 while maintaining a standard configuration on the first side 20 of the mounting interface 18 thereby allowing modular use of a single flashlight 12 design. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A flashlight assembly configured for attachment to a receiving surface, said flashlight assembly comprising:

a flashlight having an outer housing, said housing including at least two recesses formed in a exterior surface thereof; and a mounting interface having a first side configured and arranged to releasably engage said at least two recesses and a second side configured and arranged to engage said receiving surface.

2. The flashlight assembly of claim 1, said first side of said mounting interface further comprising:

a first and second clamping arm extending upwardly therefrom, said clamping arms cooperating to engage said recesses in said outer housing of said flashlight.

3. The flashlight assembly of claim 2, wherein said first and second clamping arms are capable of being deflected relative to one another to allow insertion and removal of said flashlight.

4. The flashlight assembly of claim 2, wherein said first clamping arm is fixed relative to said mounting interface and said second clamping arm is displaceable relative to said mounting interface, said second clamping arm being displaceable between a first disengaged position and second engaged position, wherein said second clamping arm cooperates with said first clamping arm to receive and retain said flashlight.

5. The flashlight assembly of claim 4 further comprising:

a locking mechanism that can be selectively engaged to prevent displacement of said second clamping arm.

6. The flashlight assembly of claim 4, wherein said second clamping arm is rotatable relative to said mounting interface.

7. The flashlight assembly of claim 4, wherein said second clamping arm is linearly translatable relative to said mounting interface.

8. The flashlight assembly of claim 1, wherein said second side of said mounting interface engages said receiving surface using threaded fasteners.

9. The flashlight assembly of claim 1, wherein said second side of said mounting interface is formed as a clamp to engage said receiving surface.

10. The flashlight assembly of claim 9, wherein said receiving surface is a helmet.

11. The flashlight assembly of claim 1, wherein said second side of said mounting base is formed to engage a standard dovetail rail profile.

12. The flashlight assembly if claim 11, wherein said receiving surface is a dovetail rail interface on a firearm.

13. The flashlight assembly of claim 1, said at least two recesses in said outer housing further comprise:

at least two recesses including side walls, wherein said side walls are arranged at an oblique angle relative to one another and disposed in an exterior surface of said housing.

14. The flashlight assembly of claim 1, said at least two recesses in said outer housing further comprising:

a radial array of alternating raised ribs and recesses extending around an exterior surface of said housing.

* * * * *